US007895712B2

(12) United States Patent
Krumbiegel et al.

(10) Patent No.: US 7,895,712 B2
(45) Date of Patent: Mar. 1, 2011

(54) DOOR HINGE FOR A MOTOR VEHICLE

(75) Inventors: Ulrich Krumbiegel, Tiefenbach-Böhringen (DE); Daniel Thierbach, Hainichen (DE)

(73) Assignee: Automotive Group ISE Industries Hainichen GmbH, Hainichen (DE)

( * ) Notice: Subject to any disclaimer, the term of this patent is extended or adjusted under 35 U.S.C. 154(b) by 79 days.

(21) Appl. No.: 11/983,330

(22) Filed: Nov. 7, 2007

(65) Prior Publication Data

US 2008/0129082 A1 Jun. 5, 2008

(30) Foreign Application Priority Data

Nov. 9, 2006 (DE) ..... 10 2006 053 197

(51) Int. Cl.
*E05D 3/10* (2006.01)

(52) U.S. Cl. .... 16/367; 16/355; 16/DIG. 43; 296/146.11

(58) Field of Classification Search ..... 16/254, 16/260–261, 264, 270–271, 355, 367, 392, 16/DIG. 43, 236–238, 343, 347, 371; 296/146.11, 296/146.12, 202
See application file for complete search history.

(56) References Cited

U.S. PATENT DOCUMENTS 2,720,673 A * 10/1955 Wise ..... 16/82
2,893,050 A * 7/1959 Hollansworth ..... 16/335
4,227,284 A * 10/1980 Zernig ..... 16/238
4,366,598 A * 1/1983 Harasaki et al. ..... 16/382
4,765,025 A * 8/1988 Salazar ..... 16/261
4,799,289 A * 1/1989 Grass ..... 16/236
4,824,162 A * 4/1989 Geisler et al. ..... 296/100.09
4,832,394 A * 5/1989 Macomber ..... 296/100.06
4,864,687 A * 9/1989 Calcaterra et al. ..... 16/237
5,210,907 A * 5/1993 Toyama ..... 16/258
5,276,944 A * 1/1994 Lin ..... 16/258
5,404,618 A * 4/1995 Heiler et al. ..... 16/261
5,412,840 A * 5/1995 Lautenschlager et al. ..... 16/238
5,412,843 A * 5/1995 Krongauz et al. ..... 16/387
5,511,287 A * 4/1996 Lautenschlager et al. ..... 16/239
5,632,065 A * 5/1997 Siladke et al. ..... 16/335
6,049,946 A * 4/2000 Cress et al. ..... 16/240
6,148,479 A * 11/2000 Lin ..... 16/258
6,149,222 A * 11/2000 Schambre et al. ..... 296/146.12
6,175,991 B1 * 1/2001 Driesman et al. ..... 16/366
6,196,618 B1 * 3/2001 Pietryga et al. ..... 296/146.11

(Continued)

FOREIGN PATENT DOCUMENTS

DE 602 03 143 1/2006

*Primary Examiner* — Shane Bomar
*Assistant Examiner* — Roberta Delisle
(74) *Attorney, Agent, or Firm* — Bachman & LaPointe, P.C.

(57) ABSTRACT

A door hinge for a motor vehicle comprises a column console that can be arranged on a column of a door frame, a door console that can be attached to a motor vehicle door assigned to the door frame, wherein the door console and the column console are pin-jointed together via a hinge pin and the door console or column console is formed from two releasably connected partial units, which rest against each other at assigned contact areas. In order to provide a separable motor vehicle door hinge with an at least two-piece door or column console, which enables a dimensionally accurate restoration of an original installation position even after a separation, it is provided that the contact surfaces on the door and/or column console are formed by delineated partial surfaces.

12 Claims, 5 Drawing Sheets

U.S. PATENT DOCUMENTS 6,584,647 B2 * 7/2003 Jacquin ..... 16/371
6,594,859 B2 * 7/2003 Barthelemy et al. ..... 16/334
6,718,596 B2 * 4/2004 Kohlstrand et al. ..... 16/374
6,942,277 B2 * 9/2005 Rangnekar et al. ..... 296/146.11
2004/0244144 A1 * 12/2004 Ham ..... 16/221

* cited by examiner

DOOR HINGE FOR A MOTOR VEHICLE

BACKGROUND (1) Field of the Invention

The invention relates to a door hinge for a motor vehicle with

- a column console that can be arranged on a column of a door frame,
- a door console that can be attached to a motor vehicle door assigned to the door frame, wherein
- the door console and the column console are pin-jointed together via a hinge pin and
- the door console or column console is formed from two releasably connected partial units, which rest against each other at assigned contact areas.

(2) Prior Art

Door hinges for motor vehicles for linking doors or covers, flaps, etc. generally have a door console, which is firmly arranged on a component that is swivel-mounted on a motor vehicle body, and a column console, which is arranged on the vehicle body. The rotating movement of the door and column console relative to each other is normally achieved through a hinge pin, by means of which the consoles are pin-jointed together.

Within the optimization of vehicle production and minimization of production costs, the motor vehicle door is meanwhile being removed again after painting after installation on a vehicle body. This takes places in order to facilitate the installation of interior motor vehicle components and the equipping of the motor vehicle door with further hardware components.

It is of considerable importance that, after this assembly work is complete, the motor vehicle door is also immediately returned to the original assembly position after painting.

A motor vehicle door hinge of the initially named type is already known from DE 602 03 143 T2, in which either the door console or the column console has a two-piece structure. These types of motor vehicle door hinges enable the removal of a door or suchlike from the motor vehicle, without separating from each other the components connected together via the hinge pin. After painting, the motor vehicle door hinge is not separated at the hinge pin, but rather via the two-piece door console or column console, wherein the provided fastening means are released. However, known constructions with at least three pieces have the disadvantage that they do not ensure to the required degree the dimensionally accurate restoration of the original installation position.

SUMMARY OF THE INVENTION

The object of the invention is to provide a separable motor vehicle door hinge with an at least two-piece door or column console, which enables a dimensionally accurate restoration of an originally set installation position even after a separation.

The object is solved through a motor vehicle door hinge with the characteristics of claim 1. Advantageous further embodiments of the invention are specified in the dependent claims.

Characteristic for the motor vehicle door hinge according to the invention is that the contact surfaces on the door and/or column console are formed by delineated partial areas.

Within the scope of the application, contact surfaces are understood to be the surfaces of the door and column console, which rest against each other in the assembled state of the two-piece door or column console. The contact surfaces are different from the surfaces in the overlapping area of the partial units provided for the production of the door console or column console, in that they are solely responsible for the alignment of the partial units. The distribution of the contact surface according to the invention into delineated partial surfaces makes it possible to coordinate them such that a mainly play-free arrangement of the partial units against each other is ensured.

In contrast to a continuous surface, the delineated partial surfaces can be particularly well aligned with each other. After this, the partial units can only be fixed in one position with respect to each other. The establishment of a connection of the partial units in different relative positions is excluded.

Furthermore, the motor vehicle door hinge according to the invention has the advantage that a paint tear, which occurs when the doors and flaps are uninstalled again for further assembly, after the entire vehicle body has been painted with the arranged hinges, doors and flaps, lies in the invisible area after final assembly.

The motor vehicle door hinge according to the invention also has the advantage that an adhesion of the partial units with respect to known motor vehicle door hinges is reduced and the paint flow is improved. The contact surfaces can be designed as small as possible and the spacing as large as necessary. A reduced adhesion drops the disassembly force. The good paint flow prevents the formation of paint pockets.

In addition to the generally freely selectable arrangement of the partial surfaces with respect to each other, which considerably increases the suitability of the motor vehicle door hinge, to ensure a high repeat accuracy of a previously set door position even after repeated disassembly and assembly, a further improvement in the fitting accuracy of the partial units with respect to each other results in accordance with an advantageous embodiment from the partial surfaces having a high dimensional accuracy and/or surface quality.

Within the scope of the invention, high dimensional accuracy and surface quality are understood to mean a tolerance of tolerance class T, particularly preferably of tolerance class S, in particular of tolerance class R for straightness and evenness (see Tolerance ISO 8015). According to the invention, a high surface quality has a surface with an average roughness depth $R_z$ of max. 1 μm, preferably max. 0.6 μm, particularly preferably max. 0.4 μm. The partial units of a motor vehicle door hinge with partial surfaces that have a dimensional accuracy and/or surface quality in accordance with this further development of the invention can be arranged on each other with particularly low positional tolerances.

The design of the partial units is, as already shown initially, generally freely selectable. In accordance with a particularly advantageous embodiment of the invention, a first partial unit surrounds a second partial unit, but in a U-shaped manner. This design of the partial units ensures their position with respect to each other due to the contact surfaces also formed on the free legs of the U-shaped partial units. Moreover, the free legs can serve as an installation, which has a special effect on the restoration of a once set installation position.

In a particularly advantageous manner, the first partial unit thereby has a level first main partial surface as well as two auxiliary partial surfaces arranged tilted with respect to the first one. This ensures that the second partial unit, which has according to a further embodiment of the invention a second main partial surface assigned to the first main partial surface of the first partial unit as well as two second auxiliary partial surfaces assigned to the auxiliary partial surfaces of the first partial unit and is also securely fixed on it in the assembled state in the transverse direction to the first partial unit designed in a U-shaped manner.

Due to the resulting conical design, the tilted alignment of the auxiliary partial surfaces enables an automatic centering of the first partial unit on the second partial unit. This centering is reproduced for each new assembly. This advantage is in particular achieved when, as described above, the partial surfaces have a particularly high surface quality and/or dimensional accuracy.

The design of the second main partial surfaces and the second auxiliary surfaces from areas deliniated from each other according to a further embodiment of the invention makes it possible to minimize the processing effort to be provided as necessary for the surfaces within the framework of quality improvements. A tilting or canting is prevented in a particularly effective manner, especially in the case of a large distance between the partial surfaces.

In accordance with a further embodiment of the invention, the second main partial surface is formed from three areas, wherein the surface of a connection area, preferably of the middle area, is set back with respect to the surfaces of the two other area and has a threaded bore hole for receiving a fastening screw for fastening the first partial unit on the second partial unit.

The central arrangement of the fastening point, namely in the middle area between the two outer areas of the second main partial surface ensures a secure connection between the main partial surfaces. Moreover, this connection ensures to a particular degree that the first partial unit automatically centers over the diagonally tilted partial surfaces on the second partial unit.

The use of the areas arranged in a spaced manner thereby ensures to a particular degree that there is overall a two-dimensional arrangement of the first partial unit on the second partial unit and there cannot be a line-shaped installation with the risk of canting or tilting.

For the further improvement of the arrangement of the first partial unit on the second partial unit, it is provided according to a further embodiment of the invention that the surface of the connection area stands back with respect to the surfaces of the other areas of the second main partial surface such that the first partial unit in the state associated with the second partial unit is deformed in the elastic area.

The setting back of the connection area, which also has the threaded bore hole for receiving the fastening screw, results in the fact that when tightening the fastening screw the first partial unit is deformed up to the installation of the first main partial surface on the connection area in the elastic area. The associated tensioning guarantees thereby a secure connection of the partial units.

This design of the connection also improves the disassembly suitability of the two partial units through the movements resulting from the tensioning. Eventually existing adhesions through the painting process are thus easier to overcome. The conical arrangement of the auxiliary partial surfaces thereby enables a play-free connection with a particularly good repeat accuracy of the position of the parts with respect to each other in the case of multiple disassemblies and assemblies.

The partial units can generally be produced in any manner. However, in accordance with a particularly advantageous embodiment of the invention, the first partial unit is formed by a bent sheet metal part and the second partial unit from a massive part, preferably a forged part. This design enables in a particular manner an arrangement, in which the first partial unit is tensioned in the assembled state on the second partial unit. The bent sheet metal part is thereby characterized through its good elastic area, which ensures a high pre-stressing.

In a particularly advantageous manner, the part of the column console that can be arranged on-board of the motor vehicle is formed from a massive part, preferably a forged part. This enables for one the good arrangement of the first partial unit on the second partial unit as well as a good fastening option of the door and column console on the vehicle body or the door. The use of a massive part, in particular a forged part, thereby ensures to a certain degree that the result is not deformations as a result of the occurring load, which could endanger the positioning security of the door on the vehicle body.

The arrangement of the first partial unit on the second partial unit takes place according to a previously shown further development of the invention by means of a fastening screw. In a particularly advantageous manner, this fastening screw is executed as a fitting screw, wherein the first partial unit has an opening for receiving of the fitting screw.

The use of a fitting screw ensures a precisely tailored and repeatable arrangement of the first partial unit on the second partial unit. In connection with another embodiment of the invention, whereby the opening in the first partial unit is designed as a long hole aligned in the transverse direction of the first partial unit, a motor vehicle door hinge can be provided, which enables to a particularly high degree a high repeat accuracy of the positioning. The long hole, which thereby extends diagonally to the auxiliary partial surfaces, ensures that the first partial unit automatically centers on the auxiliary partial surfaces arranged in a tilted manner. The arrangement of the partial units with respect to each other resulting solely from the design of the partial units is not influenced in the transverse direction through the opening for receiving of the fastening or fitting screw. In this respect, a particularly high repeat accuracy is ensured. Vertical to the orientation of the long hole, the position of the partial units with respect to each other is ensured through the fitting screw.

BRIEF DESCRIPTION OF THE DRAWINGS

An exemplary embodiment of the invention is explained in greater detail below with reference to the drawings. The drawings show the following.

DETAILED DESCRIPTION OF THE PREFERRED EMBODIMENT(S)

Figure 1:
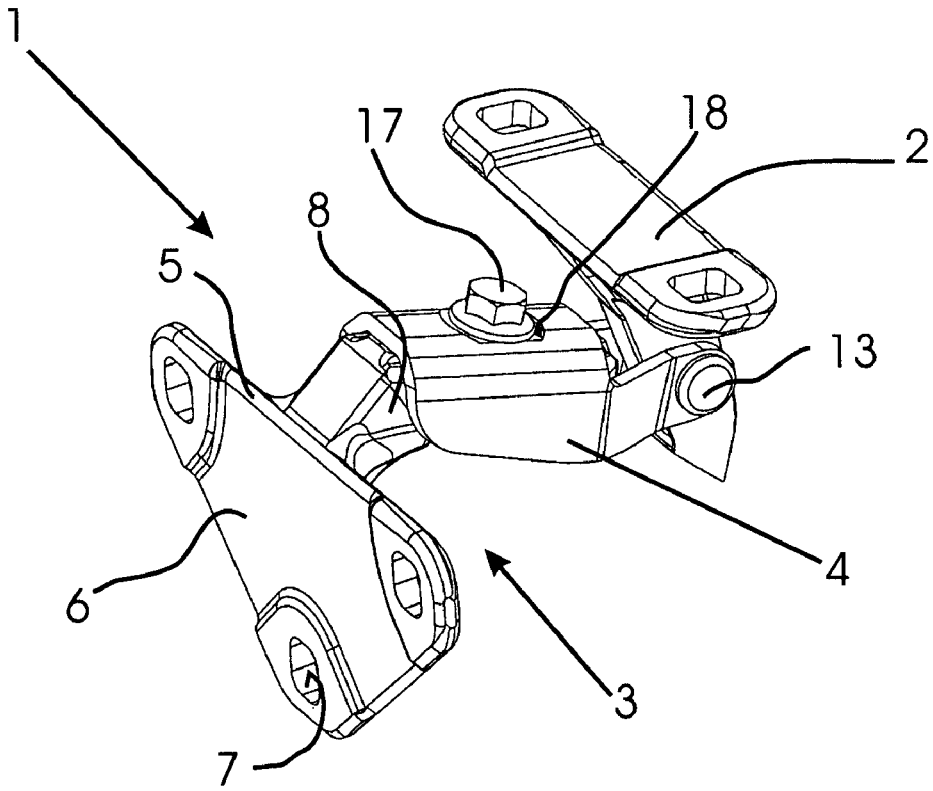
FIG. 1 shows a perspective view of a motor vehicle door hinge with a two-piece column console and a one-piece door console.
Figure 2:
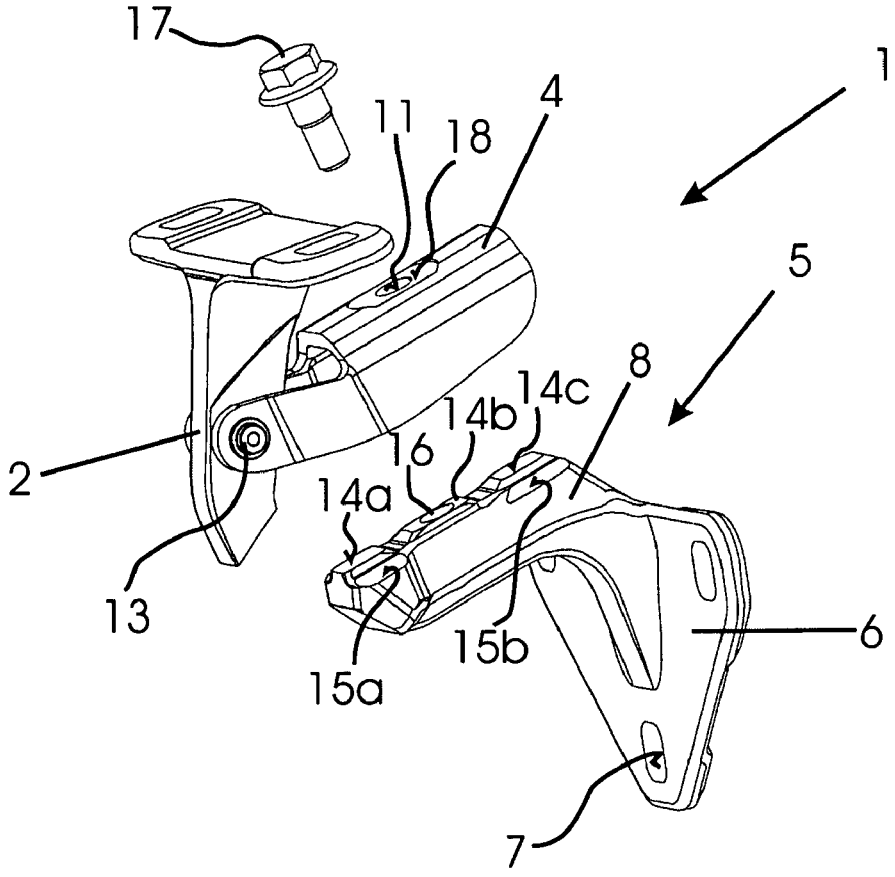
FIG. 2 shows a perspective view of the motor vehicle door hinge from FIG. 1 with a disassembled column console.
Figure 3:
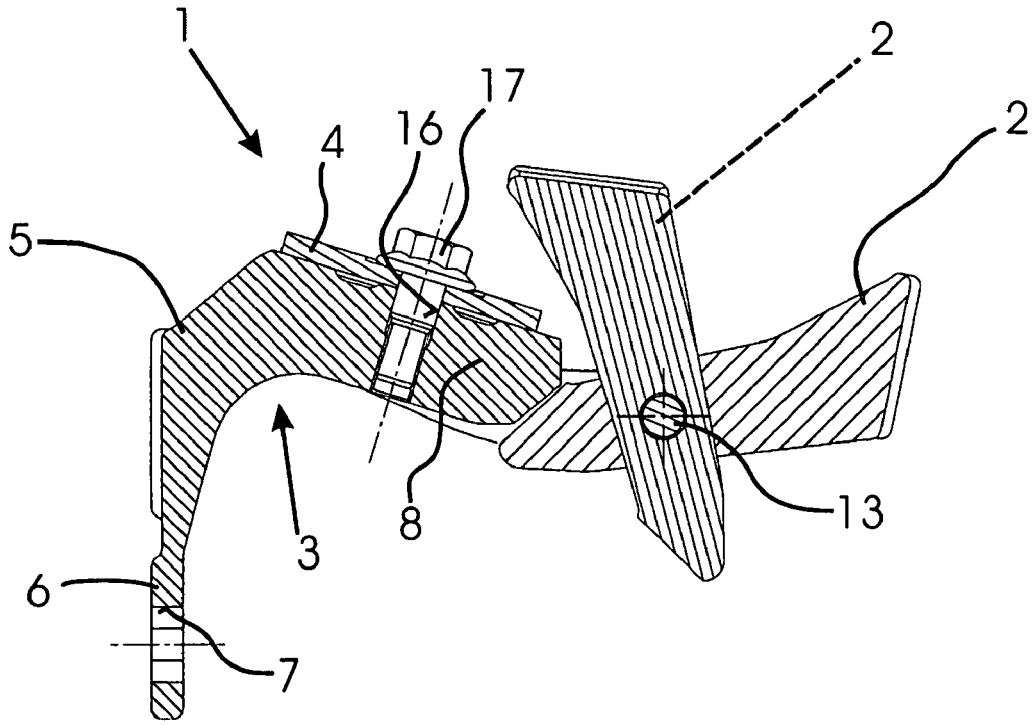
FIG. 3 shows a section of the motor vehicle door hinge from FIG. 1 with a door console represented in two positions.
Figure 4:
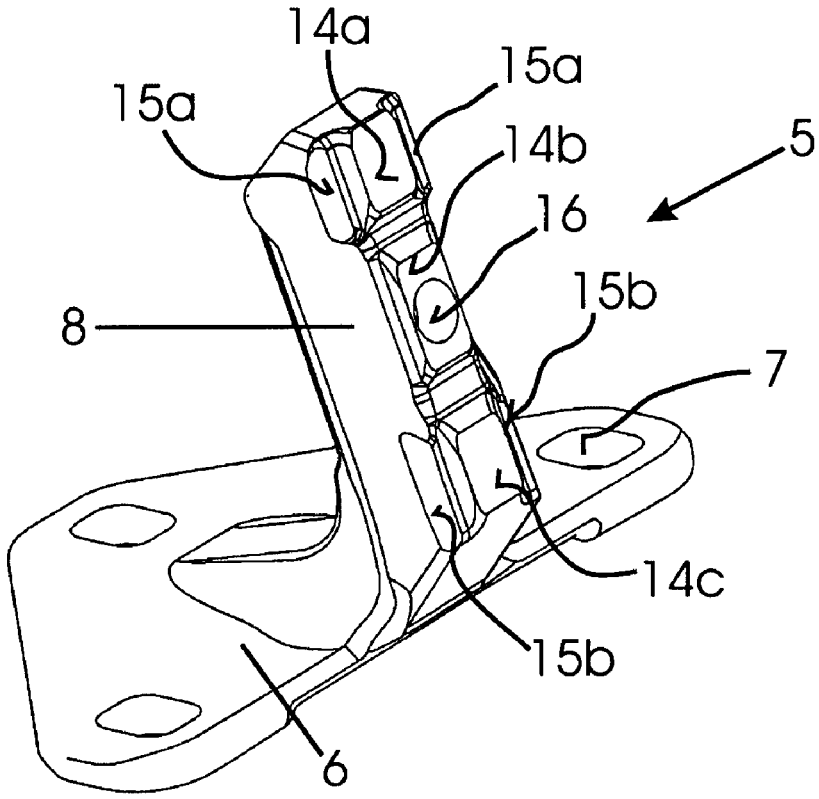
FIG. 4 shows a perspective view of the second partial unit of the column console of the motor vehicle door hinge of FIG. 1
Figure 5:
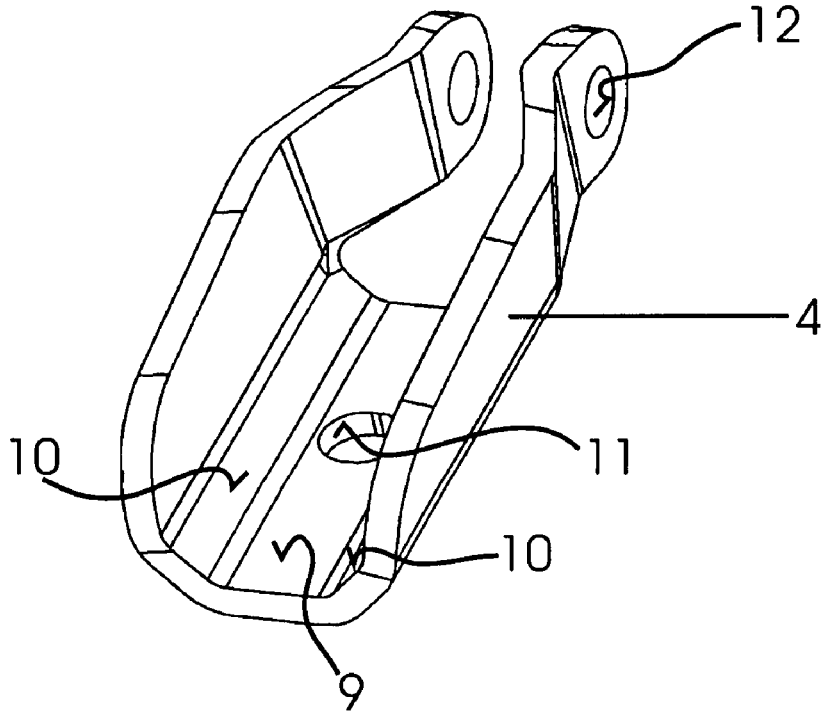
FIG. 5 shows a perspective view of the first partial unit of the column console of the motor vehicle door hinge of FIG. 1.

The motor vehicle door hinge 1 represented in FIG. 1 through 5 has a column console 3 that can be arranged on a door frame not shown here and a door console 2 that can be arranged on a door that is also not shown here. The door console 2 and the column console 3 are pin-jointed together via a hinge pin 13, which extends through the door console 2 and the hinge pin collets 12 on the column console 2.

The hinge pin collets 12 are thereby arranged on a first partial unit 4 of the two-piece column console 3 formed namely from a first partial unit 4 and a second partial unit 5. The first partial unit 4 and the second partial unit 5 are thereby connected with each other in the assembled state of the motor vehicle door hinge via a fitting screw 17.

The first partial unit 4 thereby surrounds a support arm 8 of the second partial unit 5 in a U-shaped manner and lies with a first main partial surface 9 and the first auxiliary partial surfaces 10 arranged tilted with respect to it on a second main partial surface 14*a*-14*c* and second auxiliary partial surfaces 15*a*, 15*b* of the support arm 8 of the second partial unit 5.

While the first main partial surface 9 and the first auxiliary partial surface 10 of the first partial unit 4 are designed in a continuous manner, the correspondingly designed second main partial surface 14*a*-14*c* and second auxiliary partial surfaces 15*a*, 15*b* have areas 14*a*, 14*b*, 14*c*, 15*a*, 15*b* arranged separately from each other. The second main partial surface 14*a*-14*c* is thereby separated into the oppositely arranged areas 14*a*, 14*c* and the middle area 14*b*, wherein the middle connection area 14*b* is set back with respect to the surface of the areas 14*a*, 14*c*.

The areas 15*a*, 15*b* of the second auxiliary partial surface are also arranged in a spaced manner in order to ensure a tilt-free installation. For the fastening of the first partial unit 4 on the second partial unit 5, the support arm 8 has a threaded bore hole 16 in the area of the connection area 14*b* that is suitable for receiving a fitting screw 17 projecting through a collet opening designed as a long hole 11.

The long hole 11 thereby extends in the transverse direction to the first partial unit 4 and thus ensures that the first partial unit 4 is automatically centered when the fitting screw 17 on the second partial unit 5 is tightened. The set back arrangement of the connection area 14*b* ensures a tensioning between the opposite-lying areas 14*a*, 14*c* of the second main partial surface as well as the second auxiliary partial surfaces 15*a*, 15*b* and the first main partial surface 9 as well as the first auxiliary partial surfaces 10. In order to ensure a two-dimensional arrangement of the fitting screw 17, the first partial unit 4 has a level recess 18 in the contact area with a bottom side of the screw head.

In order to fasten the column console 3 on the vehicle body, it has openings 7 arranged on a base plate 6 for receiving fastening screws not shown here.

In order to restrict the maximum opening angle, the door console 2 has a stop, which is arranged on the end lying opposite the fastening area with the door. This stop rests against the free end of the support arm 8 when the maximum opening angle is reached, wherein the end is designed such that the stop rests in a two-dimensional manner on the support arm 8.

In accordance with an exemplary embodiment that is not shown here, the opposite-lying areas 14*a*, 14*c* of the second main partial surface can be omitted. The arrangement then takes place solely between the areas 15*a*, 15*b* of the auxiliary partial surfaces that are arranged in a tilted manner and the connection area 14*b*. The connection area 14*b* is thereby arranged such that there is a defined distance when the first partial unit 4 is placed on the second partial unit 5 before the tightening of the fitting screw 17. The distance is then removed through the tightening of the fitting screw 17.

What is claimed is:

1. A door hinge for use on a motor vehicle, said hinge comprising:

a column console arranged on a column of a door frame of said motor vehicle;

a door console attached to a motor vehicle passenger door assigned to the door frame;

the door console and the column console being pin-jointed together via a hinge pin and at least one of the door console and the column console being formed from two releasably connected partial units, which rest against each other at assigned contact areas and which cannot move relative to each other when connected; and contact surfaces on at least one of the door console and column console being formed by spaced partial surfaces.

2. The motor vehicle door hinge according to claim 1, wherein the partial surfaces have at least one of a high dimensional accuracy and surface quality.

3. The motor vehicle door hinge according to claim 1, wherein said partial units include a first partial unit surrounding a second partial unit in a U-shaped manner.

4. The motor vehicle door hinge according to claim 1, wherein the first partial unit has a first main partial surface and two first auxiliary partial surfaces arranged tilted with respect to the first main partial surface.

5. The motor vehicle door hinge according to claim 4, wherein the second partial unit has a second main partial surface assigned to the first main partial surface of the first partial unit and two second auxiliary partial surfaces assigned to the auxiliary partial surfaces of the first partial unit.

6. The motor vehicle door hinge according to claim 5, wherein the second main partial surface and the second auxiliary partial surfaces are formed from delineated areas.

7. The motor vehicle door hinge according to claim 5, wherein the second main partial surface is made up of three areas and wherein a surface of a middle one of said areas is set back with respect to surfaces of the other areas and has a threaded bore hole for receiving a fastening screw for arrangement of the first partial unit on the second partial unit.

8. The motor vehicle door hinge according to claim 7, wherein the surface of the middle area is set back with respect to the surfaces of the other areas of the second main partial surface such that the first partial unit is deformed in an elastic area in a state connected with the second partial unit.

9. The motor vehicle door hinge according to claim 4, wherein the first partial unit is formed from a bent sheet metal part and the second partial unit is formed from a forged part.

10. The motor vehicle door hinge according to claim 1, wherein a part of the column console that can be arranged on-board of a vehicle is made up of a forged part.

11. The motor vehicle door hinge according to claim 4, wherein the first and second partial units are connected together by a fastening screw designed as a fitting screw and wherein the first partial unit has an opening for receiving the fitting screw.

12. The motor vehicle door hinge according to claim 11, wherein the opening is formed as a long hole aligned in a transverse direction of the first partial unit.

* * * * *